United States Patent [19]

Hamel

[11] 4,384,801

[45] May 24, 1983

[54] JUNCTION PLATE

[75] Inventor: David O. Hamel, Madison, Wis.

[73] Assignee: East-West Design Group, Madison, Wis.

[21] Appl. No.: 340,008

[22] Filed: Jan. 18, 1982

Related U.S. Application Data

[63] Continuation-in-part of Ser. No. 227,710, Jan. 23, 1981.

[51] Int. Cl.[3] ..... F16D 1/00

[52] U.S. Cl. ..... 403/172; 52/81

[58] Field of Search ..... 403/172, 176, 171, 219, 403/217, 218, 170; 52/81, 82

[56] References Cited

U.S. PATENT DOCUMENTS

| | | | |
|---|---|---|---|
| 2,803,317 | 8/1957 | Henderson . | |
| 3,270,478 | 9/1966 | Attwood | 403/218 X |
| 3,486,278 | 12/1969 | Woods | 52/81 |
| 3,844,664 | 10/1974 | Hogan | 403/171 |
| 3,857,212 | 12/1974 | Barnett | 52/81 |
| 3,861,107 | 1/1975 | Papayoti | 403/172 X |
| 3,990,195 | 11/1976 | Gunther | 52/81 |
| 4,203,265 | 5/1980 | Ivers | 52/81 |

FOREIGN PATENT DOCUMENTS

| | | | |
|---|---|---|---|
| 2421920 | 11/1975 | Fed. Rep. of Germany | 52/81 |

*Primary Examiner*—Andrew V. Kundrat

*Attorney, Agent, or Firm*—Isaksen, Lathrop, Esch, Hart & Clark

[57] ABSTRACT

A junction plate (1) for an icosahedron geodesic structure is disclosed which serves to join together the struts (4) of the structural frame. The plate (1) includes a plurality of channels (7) sized so as to firmly grasp the ends of the struts (4) so that only one bolt (5) is needed to firmly attach the strut (4) to the plate (1) with a fixed angular relationship between them. The plate (1) is constructed to minimize any plastic deformation, other than simple bending, of its material as it is formed so as to avoid weakening the strength of the plate.

13 Claims, 7 Drawing Figures

Fig 6
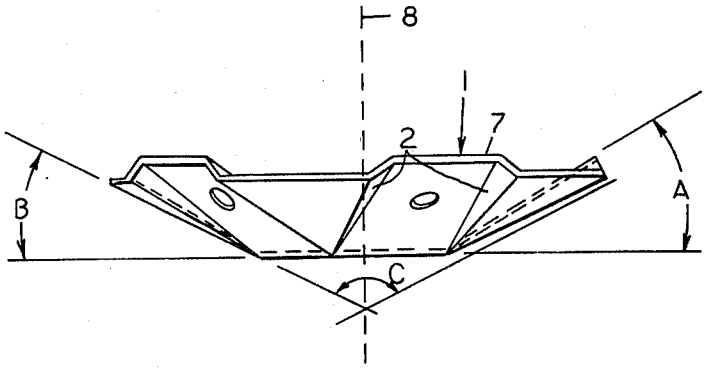
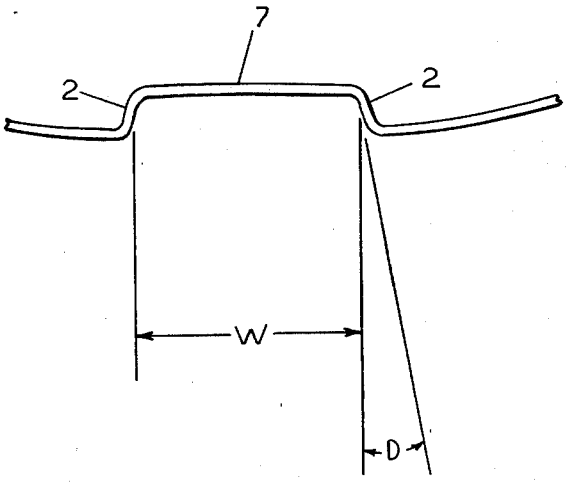
Fig 7

JUNCTION PLATE

CROSS REFERENCE TO RELATED APPLICATION

This application is a continuation-in-part application of patent application Ser. No. 227,710 filed Jan. 23, 1981.

FIELD OF THE INVENTION

The present invention relates, generally, to the construction of geodesic domes and similar geometric building constructions and, more particularly, to the design and construction of a junction plate used in joining together the strut members of the geodesic dome framework together.

BACKGROUND OF THE INVENTION

The popularity of geodesic domes is widespread, but the construction of these structures by unskilled persons has generally been limited to those who purchase in kit form the entire system with a set of complimentary framework struts and connectors, or to those who can afford a prefabricated structure. Skilled carpenters have been able to make use of construction information such as that contained in *The Dome Builder's*, John Prenis, Editor, published by Running Press, Philadelphia, Pa., 1973, for example. Until now, there has been little development of basic, inexpensive components for the construction of geodesic domes which would allow the major materials of the structure to be purchased from stock materials available at local lumberyards without the need for unusual modifications or tools. Through the use of such standardized materials, it becomes easier for more people to make use of this efficient and economical building type.

There have been examples of plates utilized as structural joints for geodesic dome-type constructions. For example, U.S. Pat. No. 3,844,664 describes an icosahedron disk which is intended to be utilized as a structural joint for a geodesic dome of the icosahedron type. The icosahedron disk described in said patent includes pairs of holes therein for the two bolts used to attach the disk to the strut members. That disk is formed from a flat plate, with a pie-shaped portion cut out therefrom, which is then bent into the proper shape so as to have the proper angles between the flat plates of the disk to form an icosahedron-type structure. Similarly, the subject matter of U.S. Pat. Nos. 3,486,278; 3,857,212 and 3,990,195 disclose geometric dome connectors or plates which may be utilized to fabricate geodesic dome structures. Each of the joint structures or plates described in these patents is relatively complex in their manufacture and require assembly or welding of numerous parts together. U.S. Pat. No. 4,203,265 describes a hub and strut system for geometric domes which includes a flat plate forming the junction plates of each of the joints of the dome structure and is a system which requires careful and accurate machining of the strut members before they can be utilized by the junction plate disclosed in the specification of that patent. A building construction is disclosed in U.S. Pat. No. 3,270,478 which includes a junction plate therein with the junction plate having portions adapted to join to strut members, with the junction plate being formed through a process including elongation of the webs of the metallic material, thereby making the junction plate more costly and difficult to manufacture than if such stretching and elongation of the metallic web material was not required. Examples in the prior art are also known of frame systems or strut assemblies which connect to counterpart hubs and which require specific interconnection structure between the hub and strut systems, such systems are disclosed in U.S. Pat. Nos. 2,803,317; 3,270,478 and 3,857,212.

BRIEF SUMMARY OF THE INVENTION

The present is summarized in that a junction plate for use in a geodesic dome structure is formed from a round disk of metallic plate material by a single stamping operation, without any elongation or stretching of the metallic material, so as to form a rigid, stiff, and properly formed junction member which may be utilized to connect easily to inexpensive framing lumber in a fashion so as to create a strong and secure geodesic dome structure by persons with limited carpentry skills.

It is an object of the present invention to allow relatively unskilled persons to construct strong and efficient geodesic dome structures from a junction plate constructed in accordance with the present invention and from inexpensive framing lumber obtainable from any lumber yard.

It is yet another object of the present invention to provide a junction plate for the construction of such geodesic dome structures which is formed from a single disk of metallic sheet material without the requirement for the stretching or elongation of any of the webs of the sheet material in its fabrication into the junction plate so as to thereby minimize the cost and problems of the manufacturing process so as to avoid any possibility of weakening portions of the web of the junction plate itself.

It is yet another object of the present invention to provide such a junction plate which aligns itself with each of the struts by means of a single fastening bolt at each end of each of the struts to the appropriate junction plate without the need for any further fastening materials between the strut and any of the other struts or junction plates involved in the building structure.

BRIEF DESCRIPTION OF THE DRAWINGS

FIG. 6 is a side elevation view of the junction plate of FIG. 1 shown upside down.

FIG. 7 is an enlarged view of an end section of the junction plate of FIGS. 1 and 6.

DESCRIPTION OF THE PREFERRED EMBODIMENT

Figure 1:
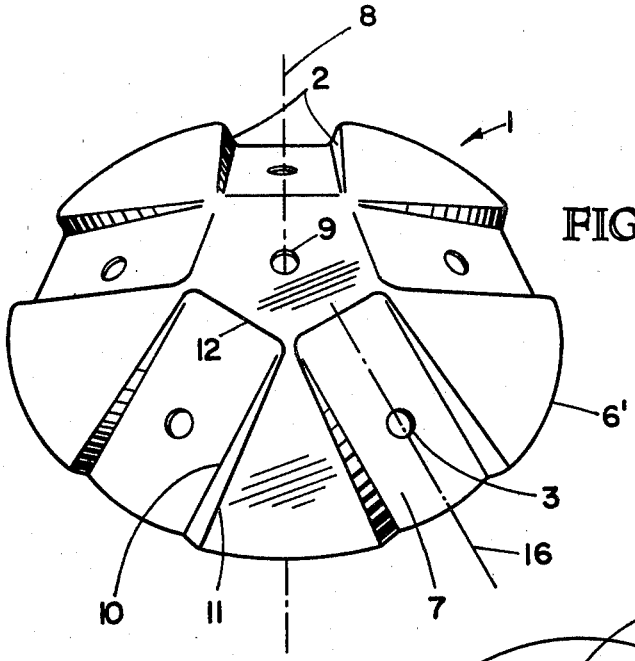
FIG. 1 is a perspective view of a junction plate constructed in accordance with the present invention.
Figure 5:
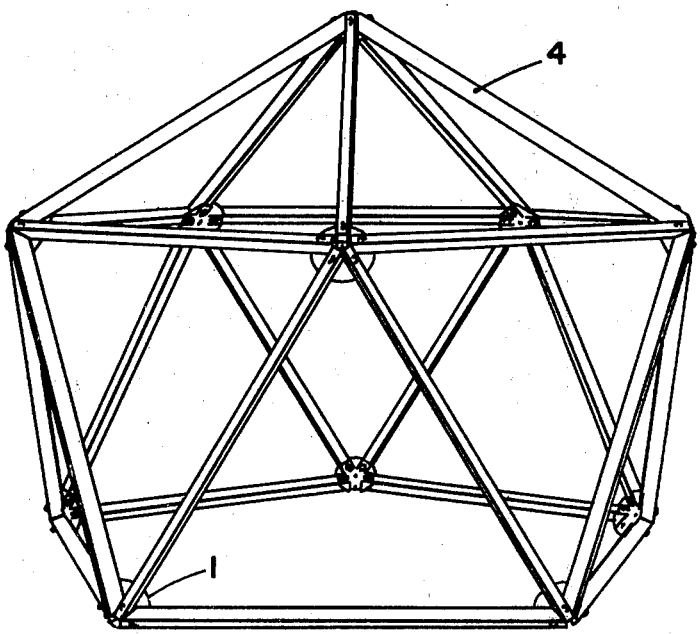
FIG. 5 is a perspective overall view of typical, simple geodesic dome structure frame constructed utilizing the junction plate of FIG. 1.

Shown in FIG. 1, and generally illustrated at 1, is a junction plate constructed in accordance with the present invention. The junction plate is for use in the construction of the structural frame of a geodesic dome-type building, such as illustrated in FIG. 5. The junction plate 1 is particularly adapted so that it can be used to construct the geodesic-type structure with the only additional equipment required being readily commercially available types of materials.

Referring in more particular to FIG. 1, the junction plate 1 is a frusto-conically shaped plate formed of sheet steel or other sheet metallic material. Formed in the junction plate 1 are a plurality of identical channels 7 each of which extends radially outward from an axially extending central axis 8 extending through a locating central hole 9 formed in the center of the junction plate 1. The center lines 16 of each of the channels 7 are positioned so as to be radially outwardly extending lines extending from the central axis 8. As can be seen by referring to FIG. 6, the bottom surface of each of the channels 7, is formed at an oblique angle relative to the perpendicular central axis 8 of the junction plate 1 so that its flat bottomed surface is positioned at an angle of approximately 31.7 degrees, designated by the reference letter A in FIG. 6, greater than perpendicular to the central axis 8 of the junction plate 1. As can be seen also by referring to FIG. 6, the web portions 17 of material formed between the adjacent identical channels 7 are canted at an oblique angle relative to the plane perpendicular to the central axis 8 by an angle designated B in FIG. 6, with this angle being preferably approximately 25 degrees. Thus two of the opposite web portions 17 formed between the channels 7 on opposite sides of the plate 1 are separated by an angle of 130 degrees, designated C in FIG. 6. Referring to FIG. 7, it can be seen that each of the channels 7 is bound by a pair of side walls 2 which determine the width of the channel 7. Each of the channels 7 is selected so as to have a relatively constant width, with that width referred to by the reference letter W in FIG. 7. The width W is selected so as to correspond to conventional commercially available framing lumber. For most purposes in the United States, it would be preferable that the width W of the channels 7 be selected to be 1.5 inches. This width W is measured at the narrowest point adjacent to the bending radius of the junction between the bottom of the channels 7 and the side walls 2. The side walls are similar to each other and taper in their heighth from a dimension of zero near the center of the junction plate 1 to their tallest dimension at the peripheral circumferential edge of the junction plate 1. Each of the side walls 2 are canted slightly outwardly from perpendicular to the bottom or the channels 7, as for instance at an angle of approximately ten degrees, indicated at D in FIG. 7, to facilitate the placement of framing lumber into the channels 7. Each of the channels 7 has provided in it a hole 3 which is located on the center line 16 of the respective channel 7. Each of the holes 3 is selected so as to correspond to the size of a standard commercially available bolt, and it is preferred that each of the holes 3 are sized so as to easily accommodate a bolt having a dimension of at least 5/16ths of an inch diameter.

Figure 3:
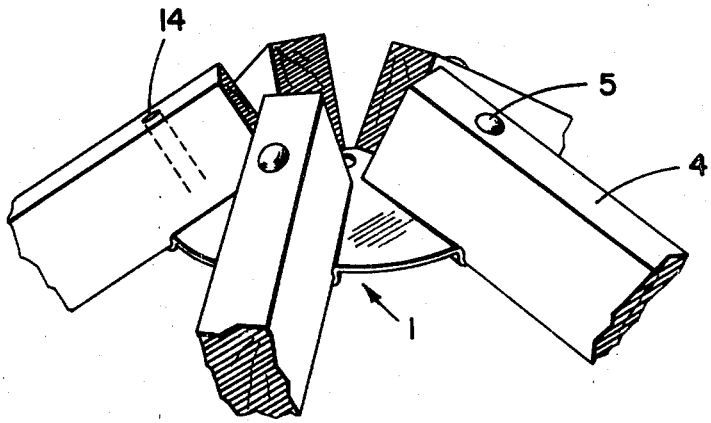
FIG. 3 is a perspective view of a joint in the construction of a geodesiic dome structure utilizing the junction plate of FIG. 1.
Figure 4:
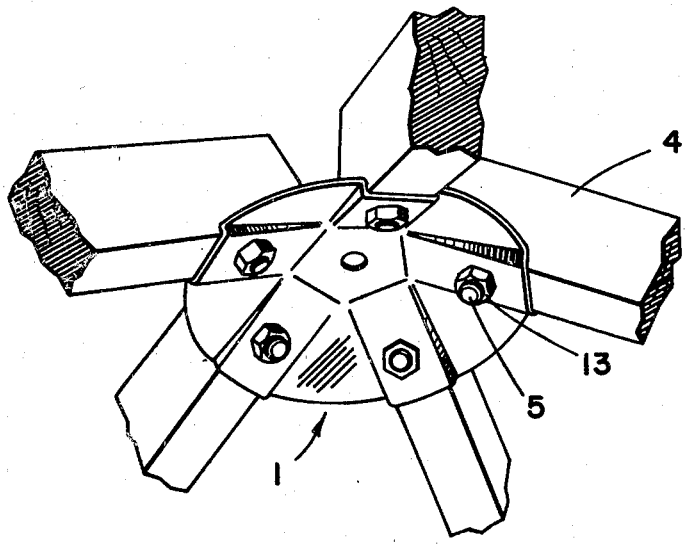
FIG. 4 is the underside perspective view of the junction in the geodesic dome structure illustrated in FIG. 3.

FIGS. 3 and 4 show the junction plate 1 as utilized in the construction of the structural frame of a geodsic-type dome construction as illustrated in FIG. 5. As can be seen in FIGS. 3 and 4, the junction plate 1 serves to join together framing struts 4 which, in the preferred embodiment of the present invention, are standard construction lumber such as 2×2's, 2×4's, or 2×6's, which have one dimension of approximately one and a half inches. The junction plate 1 is adapted to connect to the ends of as many as five of the struts 4. The ends of each of the struts 4 has provided in it a hole 14 which is located on the longitudinal center line of the small side of each strut 4 as can be seen in FIG. 3. One threaded bolt 5 is inserted through the appropriate hole 14 in the end of each of the struts 4 and then through the respective hole 3 in the junction plate 1 to which the strut 4 is to be attached. A nut 13 is used to fasten in place the bolt 5 to firmly fix the strut 4 to the junction plate 1. As the nut 13 is tightened onto the threaded bolt 5, the strut 4 is drawn into the flat bottom of the channel 7. As the strut 4 is drawn into the flat bottom of the channel 7, the side walls 2 of each of the channels 7 act as cam surfaces against the side edges of the strut 4 so as to force the end of the strut 4 into the desired position within the channel 7 and so as to also firmly fix in place and determine the angular relationship between the strut 4 and the junction plate 1. The dimension W between the side walls 2 causes the side walls 2 to bind against the side edges of the strut 4 and the fact that these side walls 2 firmly restrain the movement of the end of the strut 4 causes the struts 4 to be held by the junction plate 1 in a firm and fixed angular alignment in all three axes relative to the junction plate 1, which angular alignment is selected to be proper for the construction of a geodesic dome structure. This fixed angular alignment in all three spatial axes is achieved through the use of only a single bolt 5 in attaching each of the struts 5 to the junction plate 1 because of the critical sizing and dimensioning of the channel 7 and the fact that the channel 7 binds tightly to the side edges of the strut 4 to hold the strut 4 in firm angular relationship to the junction plate 1.

Figure 2:
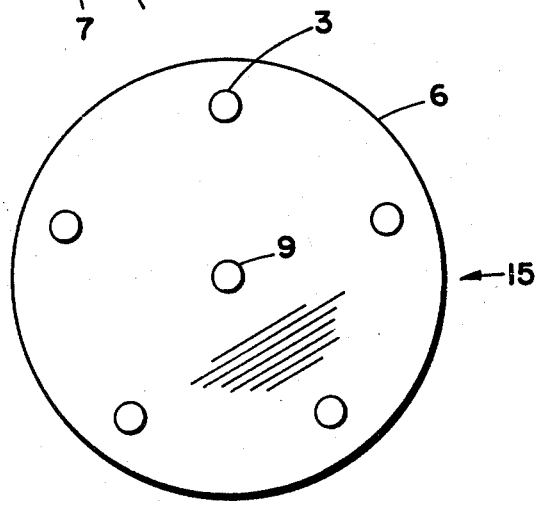
FIG. 2 is a top plan view of an unformed circular disk of steel sheet material utilized to construct the junction plate of FIG. 1.

The junction plate 1 is formed in a metal stamping die familiar to those skilled in the art of metal stamping. The junction plate 1 is preferably formed from a single disk of sheet steel or other sheet metallic material such as the disk 15 illustrated in FIG. 2. The disk 15 is provided with a pre-punched set of holes 3 intended to be located in the various channels 7, and is provided with a center guide hole 9. An additional registration hole may be provided to facilitate installation of the single disk 15 into a jig utilized for stamping the disk 15 into the junction plate 1. The height of the two walls 2 defining the edges of each of the channels 7 in the finished junction plate 1 is specifically selected so as to minimize any possibility of plastic deformation or elongation of the sheet material of the disk 15 in the metal stamping operation. It is intended that there be a minimum amount of deformation of the metallic material so as to minimize any deformations or discontinuities in the material which might give rise to structurally weak areas in the resulting junction plate 1. The deformation of the disk 15 is minimized by changing the material from its simple flat state in the disk 15 of FIG. 2 to its shape in FIG. 1 through simple linear bending at bend lines 10, 11 and 12 as indicated in FIG. 1. Except at these bend locations 10, 11 and 12, the remainder of the material in the junction plate is undeformed and unstressed during the stamping operation. The minimum deformation of the material in the junction plate 1 is achieved by designing the final shape and angles of the parts of the junction plate 1 so that the original circumference of the flat disk 15 is unchanged in its conversion into the junction plate 1. Thus, the peripheral dimension 6' of the junction plate 1, as measured by the continuous linear dimension of the exterior edge of the junction plate 1, is equal to the circumference 6 of the flat disk in its undeformed condition. In order to allow for the strut width and the corresponding channel widths and angles, the height of the walls 2 must be adjusted to insure that the initial and final peripheral dimension of the disk 15 and the finished junction plate 1 are substantially the same. For structures of practical size useful in most home and yard applications and used with struts made from conventional standard construction lumber, the diameter of the unformed disk 7 is optimally chosen to be approximately seven inches. The material of choice has been 14-gauge galvanized steel, though a variety of dimensions and material choices would clearly be adaptable for other applications and sizes.

FIG. 5 illustrates a simple geodesic dome frame which is in the shape of an icosahedron joined at its junctions by the junction plate 1 constructed in accordance with the present invention. This icosahedron requires 11 structural junction plates 1, each with 5 flat-bottomed channels 7. Each strut 4 of this frame work is identical in length. In this embodiment, the angle of the channel 7 from the central axis 8 of the junction plate 1 is 121.7 degrees, or 31.7 degrees more than perpendicular, and either four or five struts 4 are joined to each junction plate 1 in a radial configuration that is 72 degrees around the central axis 8. Other frames for geodesic structures of different geometric configuration will, of course, require other numbers of struts, angles and dimensions.

Thus, the junction plate of the present invention allows a geodesic dome structure to be constructed by a relatively unskilled and unsophisticated workman in a more efficient and rapid fashion than was heretofore possible in the prior art. To construct the geodesic dome structure, the workman requires only conventional framing lumber to serve as the struts 4, a supply of the junction plates 1 and a supply of bolts 5. In forming the struts 4, they merely must be cut to length and have a hole 14 drilled in their end. Then the structure itself may be assembled by inserting the bolts 5 through the holes 14 and the struts 4 and the holes 3 in the appropriate junction plates 1. One feature of the present invention which is most advantageous in achieving this ease of construction is the fact that the side walls 2 of the channels 7 cam against the sides of the struts 4 to force the strut into the proper angular relationship with the plate 1 and to firmly fix the angular relationship between the struts 4 and the junction plate 1. This allows a rigid, stiff, and properly assembled geodesic dome structure to be assembled by a unskilled user with a minimum possibility of any misalignment or improper construction. Since the joint between each of the struts 4 and the adjacent junction plate 1 requires only a single bolt to be firmly, fixedly and accurately fastened together, the geodesic dome frame structure, as shown in FIG. 5, can be erected in a faster time than was heretofore possible using the prior art structure. Therefore, the use of the present invention allows such a structure to be constructed not only more efficiently and economically, but also quicker than was heretofore possible.

While the present invention has been particularly described in terms of the specific embodiment, it is to be understood that in view of the present disclosure that numerous variations in the angles and numbers of strut locations are possible without departing from the principles of the present invention. Accordingly, the present invention is to be broadly construed and limited only by the scope and spirit of the following claims.

I claim:

1. A junction plate for securing a plurality of struts (4) into a structural frame comprising:

a concave plate (1) having a generally frusto-conical shape corresponding generally to the shape of the junctions in the structural frame;

a plurality of channels (7) formed in the plate (1) oriented to extend radially outward from the center thereof, each of the channels (7) having a hole (3) formed therein adapted to receive a fastening bolt (5) therethrough to fasten an end of one of the struts (4) in the channel (7);

a pair of side walls (2) defining the sides of each of the channels (7), the side walls (2) being spaced apart a distance corresponding to the width of the strut (4) to be received in the channel (7) and being of sufficient height so that the side walls (2) of the channel (7) are adapted to cooperate with the fastening bolt (5) to effectively fix the angular relationship between the strut (4) and the plate (7); and a web portion (17) of the plate extending between the upper margins of the side walls (2) of each adjacent pair of channels (7) to fix the angular spacing of the channels (7) and provide a substantially continuous rigid plate structure.

2. A junction plate as claimed in claim 1 wherein the side walls (2) are constructed canted outwardly at an angle (D) greater than perpendicular relative to the channel (7) so that the side walls (2) can act as cam surfaces to urge the strut (4) into its proper angular relationship with the plate (1) as the bolt (5) is tightened to bind the strut (4) to the plate (1).

3. A junction plate as claimed in claim 2 wherein the side walls (2) are canted outward at an angle 10 degrees greater than perpendicular to the channel (7).

4. A junction plate as claimed in claim 1 wherein the distance (W) the sidewalls (2) are spaced apart is approximately 1.5 inches.

5. A junction plate as claimed in claim 1 wherein there are five of the channels (7) oriented equally spaced from each other around the plate (1) so that the plate (1) is adapted for construction of an icosahedron shaped structural frame.

6. A junction plate as claimed in claim 1 wherein the channels (7) are oriented at an angle (A) of approximately 31.7 degrees greater than perpendicular to the central axis of the plate (1).

7. A junction plate as claimed in claim 6 wherein the web portions (17) of the plate between the channels (7) are oriented at an angle (B) of approximately 25 degrees greater than perpendicular to the central axis of the plate (1).

8. A junction plate formed by stamping from a metal disk for securing a plurality of struts (4) into a structural frame, the junction plate comprising:

a concave metal plate (1) forming into a generally frusto-conical shape corresponding generally to the shape of the junctions in the structural frame;

a plurality of channels (7) formed in the metal plate (1), each channel (7) being oriented to extend outward from the central portion of the metal plate (1) along a radially extending channel center line (16) at an oblique angle to the axis of the disc and being defined by a first bend line (12) near the center of the plate (1) extending generally perpendicular to the radially extending center line (16) of the channel (7), a pair of second bend lines (10) extending from near the ends of the first bend line (12) substantially parallel to the channel center line (16) to the periphery of the plate (1), and a pair of third bend lines (11) extending from near the ends of the first bend line (12) to the periphery of the plate (1) in diverging relation to the second bend lines (10), each of the channels (7) being adapted to engage an end of a strut (4) in rigid supporting relation; and a pair of side walls (2) each extending between adjacent second and third bend lines (10), (11) to further define the sides of each of the channels (7), the side walls (2) increasing in height toward the periphery of the plate (1), the height of the side walls (2) being selected so that the peripheral dimension (6') of the junction plate (1) is substantially equal to the circumference (6) of the metal disc from which the plate (1) was stamped so that a minimum amount of deformation of the material of the plate (1) is performed during its stamping, deformation being substantially limited to the area of the bend lines (12), (10), (11).

9. A junction plate as claimed in claim 8 wherein each of the channels (7) has a hole (3) formed therein adapted to receive a bolt (5) therethrough to fasten an end of one of the struts (4) in the channel (7).

10. A junction plate as claimed in claim 9 wherein the side walls (2) are separated by a distance corresponding to the width of the strut (4) so that the side walls (2) together with the bolt (5) fix the angular relationship between the strut (4) and the plate (7).

11. A junction plate as claimed in claim 10 wherein the side walls (2) are canted outwardly at an angle (D) greater than perpendicular relative to the channel (7) so that the side walls (2) can act as cam surfaces to urge the strut (4) into its proper angular relationship to the plate (1) as the bolt (5) is tightened.

12. A junction plate as claimed in claim 11 wherein the side walls (2) are canted outwardly at an angle (D) ten degrees greater than perpendicular to the channel (7).

13. A junction plate for securing a plurality of struts (4) into a structural frame comprising:

a concave plate (1) formed without radially cutting the plate structure into a generally frusto-conical shape corresponding generally to the shape of the junctions in the structural frame;

a plurality of channels (7) formed in the plate (1) oriented to extend radially outward from the center thereof, each of the channels (7) being adapted to engage an end of one of the struts (4) in the channel (7) in rigid supporting relation;

a pair of side walls (2) defining the sides of each of the channels (7), the side walls (2) being spaced apart a distance corresponding to the width of the strut (4) to be received in the channel (7) and being of sufficient height so that the side walls (2) of the channel (7) are adapted to cooperate with the fastening bolt (5) to effectively fix the angular relationship between the strut (4) and the plate (7); and web portions (17) of the plate extending between the upper margins of the side walls (2) of each adjacent pair of channels (7) to fix the angular spacing of the channels (7) and provide a substantially continuous rigid plate structure.

* * * * *